United States Patent [19]

Watanabe et al.

[11] Patent Number: 4,859,095

[45] Date of Patent: Aug. 22, 1989

[54] PRINTING HEAD WITH CURRENT PASSING THROUGH THE PRINT WIRE

[75] Inventors: Kazuo Watanabe; Yutaka Takahashi; Masaaki Takimoto, all of Tokyo, Japan

[73] Assignee: Fuji Photo Film Co., Ltd., Japan

[21] Appl. No.: 86,430

[22] Filed: Aug. 18, 1987

[30] Foreign Application Priority Data

Aug. 20, 1986 [JP] Japan ..... 61-194837
Aug. 20, 1986 [JP] Japan ..... 61-194838

[51] Int. Cl.[4] ..... B41J 3/12
[52] U.S. Cl. ..... 400/124; 101/93.05
[58] Field of Search ..... 400/121, 124, 157.2; 101/93.04, 93.05

[56] References Cited

U.S. PATENT DOCUMENTS 4,501,506 2/1985 Weeks et al. ..... 400/124 GT
4,600,322 7/1986 Vermot-Gand et al. ..... 400/124

FOREIGN PATENT DOCUMENTS 1423518 2/1976 United Kingdom ..... 400/124

*Primary Examiner*—David A. Wiecking
*Attorney, Agent, or Firm*—Pasquale A. Razzano

[57] ABSTRACT

In a printing head, an actuator pin positioned within a magnetic field is bent to form at least one V-shaped portion and is fixed at the end portion thereof. When current flows in the actuator pin during printing, the actuator pin is caused to be expanded and contracted by an electromagnetic force to thereby print a dot. A plurality of guide grooves are formed on both side faces of a conductive common guide plate. The end portion of the actuator pin is fixed at the guide groove in an insulating condition, and the tip of the actuator pin is movably fitted in the guide groove in an electrically conductive state.

9 Claims, 5 Drawing Sheets

PRINTING HEAD WITH CURRENT PASSING THROUGH THE PRINT WIRE

BACKGROUND OF THE INVENTION

The present invention relates to a low-noise printing head for use in wire-dot printers, and more particularly, to an improvement on a printing head having print pins which are driven using electromagnetic force.

Of wire-dot printers presently used as output apparatus for computers, a clapper type printer is mainly used. In a clapper type printer, an armature is disposed at the end of a wire. The wire end is hammered with the armature against the force of a spring while it is attracted by electromagnetic force. The tip of the wire is then projected out of the print head to record a dot on a recording paper through an ink ribbon.

Since noises are produced when armatures strike the wire ends, development of a low-noise wire-dot printer has been desired for long. An electrodynamic type printing head as disclosed in Japanese Patent Unexamined Publication No. 60-206, 669, corresponding to U.S. Pat. No. 4,600,322 to Vermot-Gaud et al, has a bright future for use in a low-noise wire-dot printer. In an electrodynamic type printing head, conductive actuator pins fixed at their ends are disposed within a magnetic field. When current flows through the actuator pins, the generated electromagnetic force deforms the actuator pins to thereby project outwardly of the print head print pins fixedly mounted at the tip of the actuator pins. Since the printing head of this type does not use impact force to move a print pin, noises are rarely produced by the printing head. The structure thereof is simple.

However, since the above-described conventional actuator pin has a curved shape, sufficient rigidity (spring constant) cannot be obtained so that a high speed print is not possible.

Meanwhile, in order to improve a print quality, it is necessary to use a number of pins. For example, a clapper type wire-dot printer used mainly in this field has a number of print pins, with 9 to 12 pins disposed in a stagger fashion in each of two arrays along the height (about 3 mm) with respective to a print character. However, the above-described low-noise electrodynamic type printing head has actuator pins which project laterally relative to each other. Therefore, if actuator pins are disposed in a stagger fashion in two arrays at a same interval as that of the clapper type, adjacent pins may contact each other. To avoid this, an actuator pin having a diameter smaller than 0.1 mm may be used. However, this makes a dot size too small for obtaining a good quality of print. Besides, there arises a problem of a low mechanical strength of the actuator pin.

In order to avoid contact of adjacent two pins, pins may be disposed as shown in FIG. 9 which shows a horizontal cross section of a printing head. A printing pin 4 is fixedly mounted at the tips of two actuator pins 2 and 3 constituting a first array. Similarly, a printing pin 7 is fixedly mounted at the tips of two actuator pins 5 and 6 constituting a second array. The ends 2*a* of actuator pins are fixed at a head frame 8 in which the above elements are housed. Print pins 4 and 7 in the respective arrays are movably inserted into holes formed in the head frame 8.

As current flows through a pair of actuator pins 2 and 3, electromagnetic force is generated in the direction indicated by arrows or in the opposite direction, depending on the direction of the current flowing through the actuator pins. As a result, the actuator pins 2 and 3 are deformed moving apart from each other or coming near each other to thus effect a straight movement of the printing pin 4. For the stagger arrangement of print pins 4 in two arrays, it is necessary to ensure a sufficient lateral space among them so as to avoid any contact of actuator pins while they are elastically deformed. With this arrangement, however, a distance between print pins 4 and 7 becomes large so that a high density arrangement of print pins is not possible. Also in this case, adjustment of ink dot positions during printing becomes difficult, and the lateral length of the printing head becomes long.

If a printing head contacts an ink ribbon, a recording paper will be blurred. It becomes necessary, therefore, to maintain a clearance larger than 300 microns between the printing pin and the recording paper. With a larger clearance between the printing pin and the recording paper, not only a recording paper can be easily set at the printer, but also it becomes possible to use a plurality of sheets of pressure sensitive paper for multiple print.

The amount of movement of a printing pin of the above-described electrodynamic type printing head is proportional to the magnetic flux density, current value and length of actuator pin. A large permanent magnet is required for a strong magnetic flux, and a large power consumption for a large current value, thus leading to disadvantages. Consequently, it is better to use long actuator pins. However, with a conventional curved actuator pin which extends laterally, it is necessary to employ a large lateral dimension in order to obtain a sufficient length of actuator pins. However, as the lateral dimension becomes large, the printing head becomes bulky and a large permanent magnet is required for covering such a broad magnetic field.

OBJECTS OF THE INVENTION

It is a principal object of the present invention to provide a printing head for use in a wire-dot printer capable of high speed printing.

It is another object of the present invention to provide a printing head for use in a wire-dot printer enabling a high density arrangement of print pins and a compact dimension.

It is a further object of the present invention to provide a printing head for use in a wire-dot printer capable of obtaining a sufficient effective length of an actuator pin without making large the laterally extending length thereof.

It is another object of the present invention to provide a printing head for use in a wire-dot printer capable of obtaining a sufficient stroke of a printing pin and disposing print pins at high density.

SUMMARY OF THE INVENTION

To achieve the above and other objects, the actuator pin according to this invention is bent in a V-character shape. The V-bent actuator pin has a high rigidity (spring constant) so that the resonance frequency thereof becomes high. Thus, high-frequency pulses may be supplied to the actuator pin to accordingly enable a high speed printing In order to perform a high density arrangement of print pins with a small laterally extending length, a common guide plate is used which is formed with a plurality of guide grooves at both side faces thereof in a stagger fashion or in a facing fashion, each V-bent actuator pin being fitted in each guide groove and fixedly connected at its end to the common guide plate. In addition, use of a zigzag actuator pin having plural bending portions allows a longer effective length to thereby enable a larger stroke of a print pin.

The common guide plate is made of conductive material to form a current path with an actuator pin. In this case, an insulation sleeve is provided at the end portion of the actuator pin so that only the tip of the actuator pin electrically contacts the common guide plate. Alternatively, if a common guide plate made of insulation material such as plastics is used, a conductive brush may be provided at the portion of the guide groove where the tip of an actuator pin contacts to form a current path.

BRIEF DESCRIPTION OF THE DRAWINGS

The above and other objects and advantages of the present invention will become apparent from the following detailed description when read in conjunction with the accompanying drawings, wherein.

DETAILED DESCRIPTION OF THE INVENTION

Figure 1:
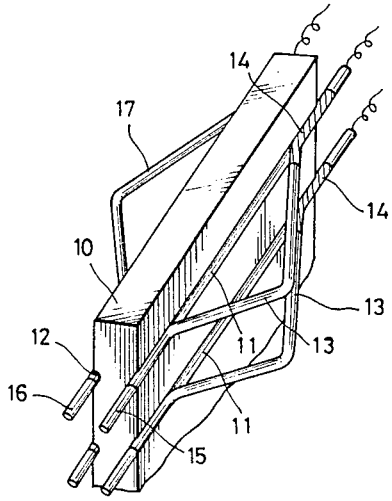
FIG. 1 is a perspective view of an embodiment of a printing head with actuator pins disposed in a stagger fashion on a common guide plate according to the present invention.

Referring to FIG. 1, a common guide plate 10 is made of conductive material such as copper, brass, aluminum and other metals, and is formed at a right side face a plurality of guide grooves 11 and similarly at a left side face a plurality of guide grooves 12. The guide grooves 12 each are positioned at the midst of two adjacent right guide grooves 11 so that two arrays of guide grooves 11 and 12 are configured in a stagger fashion.

An actuator pin 13 is made of, for example, phosphor bronze, berylium-copper alloy or the like, and is bent in a V-character shape generally at its middle. The actuator pin has a high rigidity due to its V shaped bending portion and hence a high resonance frequency, to thereby enable to drive it with a high frequency drive signal as seen in FIG. 1 the V-shaped portions of the pins include an apex 13' and a pair of straight angularly related legs 13'' extending therefrom. Accordingly, it is possible to improve the printing speed and make the number of print characters per unit time large. An insulation sleeve 14 is provided at the end portion of the actuator pin 13 which is fitted in the guide groove 11 formed in the common guide plate 10 and fixedly connected thereto with adhesive agent. The tip portion of the actuator pin 13 movably engages with the guide groove 11 while maintaining good electrical contact with the common guide plate 10. The tip of the actuator pin 13 is connected to a printing pin 15 made of a highly durable metal, such as stainless steel. Similarly, each actuator pin 17 fitted in the guide groove 12 formed at the left side face of the common guide plate 10 is connected at its tip with a printing pin 16.

Figure 2:
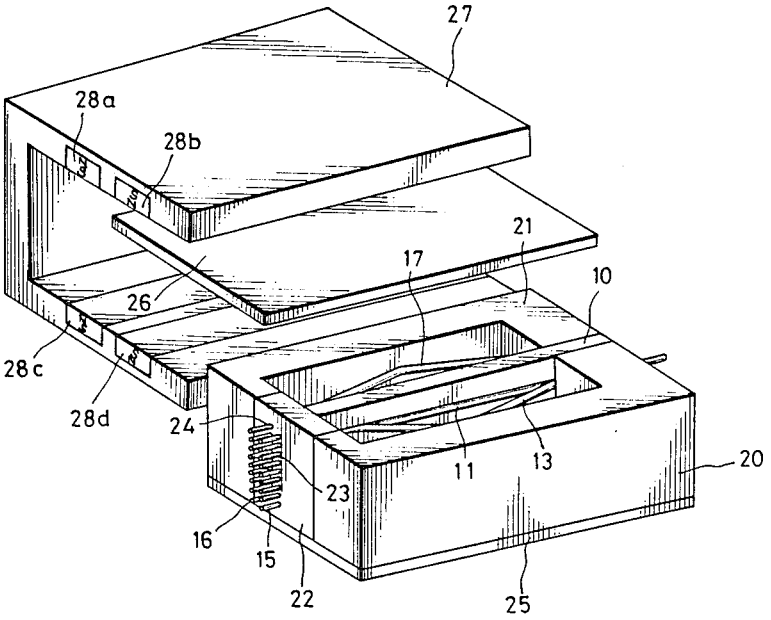
FIG. 2 is a perspective view partially disassembled showing briefly a printing head.

FIG. 2 is a schematic diagram showing a printing head of this invention. The common guide plate 10 is glued to a pair of side walls 20 and 21 of generally rectangular shape with its one side removed, which side walls are made of a molded bakelite plate. A support 22 is fixed to the front of the common guide plate 10 and formed with through-holes 23 and 24 in two arrays through which the print pins 15 and 16 are inserted. Brass plates 25 and 26 are fixedly mounted on the top and bottom of the side walls 20 and 21. The combination of the side walls and the brass plates are housed within a magnet holder 27 made of non-magnetic material. Four permanent magnets **28*a* to 28*d* are mounted in the magnet holder 27, to supply an upward magnetic field by the permanent magnets 28*a* and 28*c*, and a downward magnetic field by the permanent magnets 28*b* and 28*d*. Adjacent two permanent magnets, e.g., magnets 28*a* and 28*b***, are magnetically shielded by the common guide plate interposed in the magnetic path therebetween.

Figure 3:
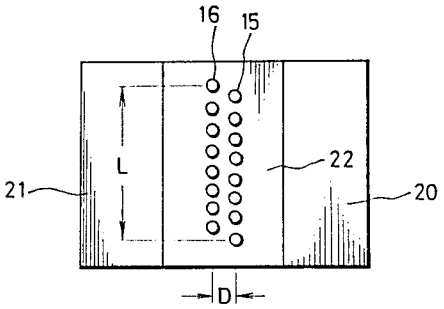
FIG. 3 is a front view of a printing head.
Figure 9:
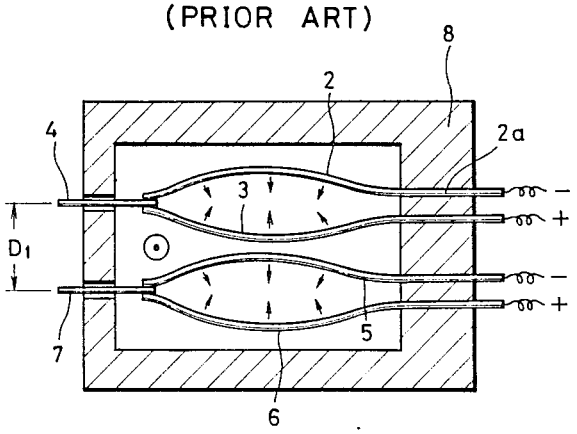
FIG. 9 (PRIOR ART)
FIG. 9 is a cross section showing a conventional printing head structure.

FIG. 3 shows an example of the arrangement of print pins. In this embodiment, one actuator pin is used for each printing pin so that the distance D between arrays becomes approximately half the distance D shown in FIG. 9. Therefore, a high density arrangement of print pins becomes possible. In addition, since the laterally extending quantity of actuator pins is small, a compact printing head can be realized.

Figure 4:
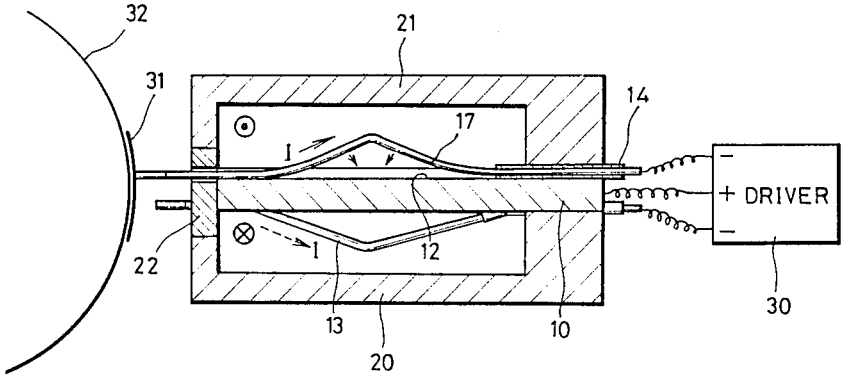
FIG. 4 is a cross section of a printing head at a printing state.

FIG. 4 illustrates the use of a printing head according to this invention. A driver 30 is supplied with a positive potential at its common electrode 10. Switches connected to respective actuator pins 13 and 17 are selectively turned on for a predetermined period to drive desired actuator pins. A current I accordingly flows from the common guide plate 10 into the turned-on actuator pin. A magnetic field in the downward direction perpendicular to the drawing figure is being applied to the actuator pin 13 by the permanent magnets **28*b* and 28*d*, whereas a magnetic field in the upward direction is being applied to the actuator pin 17 by the permanent magnets 28*a* and 28*c*. Therefore, an actuator pin with the current I flowing therein moves or is bent toward the surface of the common guide plate 10 to project its print pin. The printing pin strikes a recording paper 32 wound about a platen via an ink ribbon 31 and transfers an ink dot on the recording paper 32**.

The actuator pins 13 and 17 may be made of a berylliu-copper alloy wire or a phosphor bronze wire having a diameter of 0.25 mm and a length of 65 mm. The tip of the actuator pin is coupled to a printing pin made of, for example, a stainless steel bar having a diameter of 0.25 mm. The common guide plate 10 is made of brass and worked into the thickness of 2 mm and a length of 50 mm. The support 22 is made of a ruby plate in which nine holes 23 and 24 having a diameter of 0.27 mm are formed at a pitch of 0.35 mm. The side walls 20 and 21 are made of bakelite. It is preferable to interpose an insulation film between the actuator pins in a same array to eliminate the interference therebetween.

When a current of 8 A was applied to the actuator pin for 0.5 msec, the amount of movement of a printing pin was about 50 microns.

Figure 5:
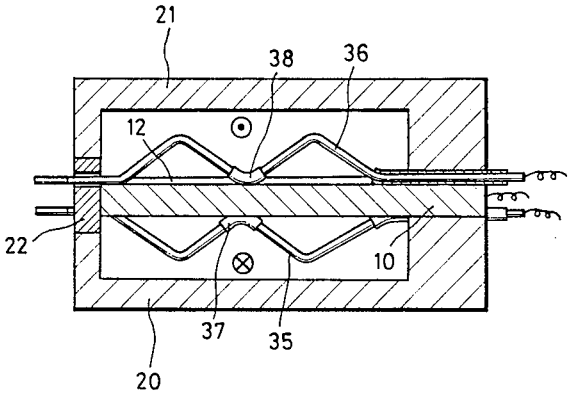
FIG. 5 is a cross section showing another embodiment of the printing head with actuators bent in a zigzag fashion according to the present invention.

FIG. 5 shows another embodiment of a printing head. In this embodiment, each actuator pin 35 and 36 has five bending portions to form two V-bent portions. Reference numbers 37 and 38 denote insulation sleeves. With this printing head, it becomes possible to achieve a high density arrangement of print pins and to make the printing head compact. In addition, since the effective length of an actuator pin becomes long, the amount of movement of a printing pin becomes large. With a large amount of movement of a print pin, a recording paper can be easily set and a multiple print using pressure sensitive sheets becomes possible.

In the above embodiments, magnetic fields of a different direction are applied to the actuator pins at the right and left arrays. However, magnetic field of a same direction may be used by properly selecting the polarity of signal pulses. Further, an insulation layer may be provided in the common guide plate at the middle thereof, to thus process signals without taking the interference between the operations of the right and left sides into consideration.

Figure 6:
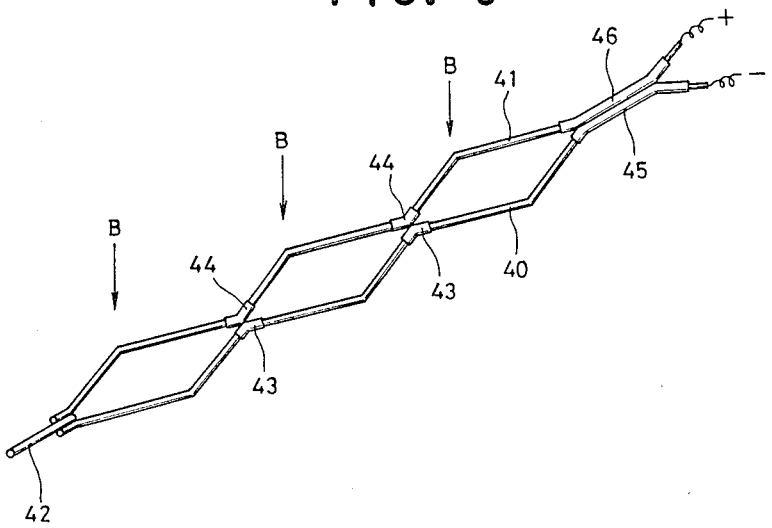
FIG. 6 is a perspective view showing a further embodiment of the printing head wherein a printing pin is fixed at the tip of two actuator pins bent in a zigzag fashion.

FIG. 6 shows another embodiment of a printing head having a larger stroke of a print pin. Actuator pins 40 and 41 are bent in a zigzag fashion, and a printing pin 42 is joined to the tips thereof. Insulation sleeves 43 and 44 made of flexible material such as rubber or plastics are provided at the bending or articulation portions of the actuator pins 40 and 41 between the adjacent legs of each pair of V-shaped portions thereof to prevent short circuits therebetween. The insulation sleeves which are used as an articulation are fixed using adhesive agent, wire or the like.

Insulation sleeves 45 and 46 are also provided at the end portions of the actuator pins 40 and 41, the end portions being fixedly connected to the head frame. The two actuator pins 40 and 41 form a plurality of expandable and contractive rhombi, a constant magnetic field B being applied by permanent magnets (not shown) in the direction perpendicular to the rhombus face.

Figure 7:
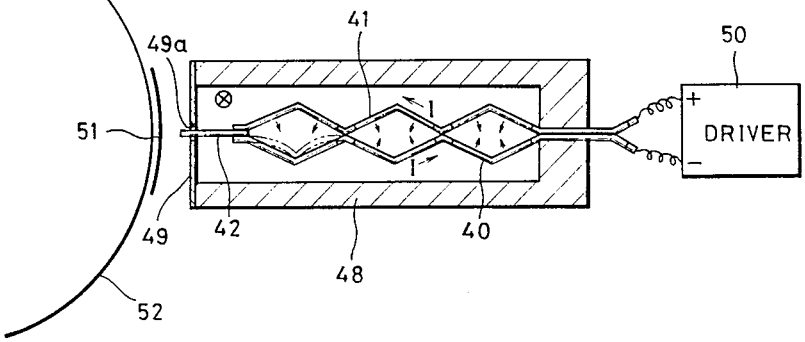
FIG. 7 is a cross section showing the printing head assembled with the actuator pins shown in FIG. 6.

FIG. 7 is a schematic diagram showing the printing head constructed of actuator pins shown in FIG. 6. A pair of actuator pins 40 and 41 are housed in the head frame 48 and have their end portions fixed to the head frame 48. A guide plate 49 is fixed at the front of the head frame 48, print pins 42 being inserted into holes 49 formed in the guide plate 49. A magnetic field is applied in the direction perpendicular to the drawing figure by permanent magnets (not shown).

When a current I is caused to flow in the pair of actuator pins 40 and 41 from a driver 50, a force in the direction indicated by arrows is generated in the actuator pins 40 and 41 through interaction between the magnetic field and the current. As a result, the intermediate portions between articulations are bent inside as shown by dotted lines, to thereby project the printing pin 42 forward. The printing pin 42 strikes a recording paper 52 through an ink ribbon 51 to transfer an ink dot on the recording paper 52. In this embodiment, since the actuator pins 40 and 41 are formed in a zigzag fashion by increasing the number of bending portions, a long effective length becomes possible to thereby make the stroke of a printing pin large.

The actuator pins 40 and 41 may be made of a berylliu-copper alloy wire or a phosphor bronze wire having a diameter of 0.25 mm and a length of 65 mm. The tip of the actuator pin is connected to a printing pin 42 made of, for example, a stainless steel bar having a diameter of 0.25 mm. The guide plate 49 is made of a ruby plate in which holes **49*a* having a diameter of 0.27 mm are formed. The head frame 48** is made of bakelite.

In practice, a plurality of print pins are disposed in arrays at the pitch of 0.27 mm. In this case, to eliminate the interference between upper and lower adjacent actuator pins, an insulation film such as a polyester film of 0.025 mm is interposed therebetween. The insulation film is held in position using a pair of bakelite plates of 0.33 mm thickness and of an L-character shape. Thus, the insulation films and the bakelite plates are laminated one upon another, and the end portions of a pair of actuator pins are squeezed to fixedly bond the bakelite plates with adhesive agent.

Figure 8:
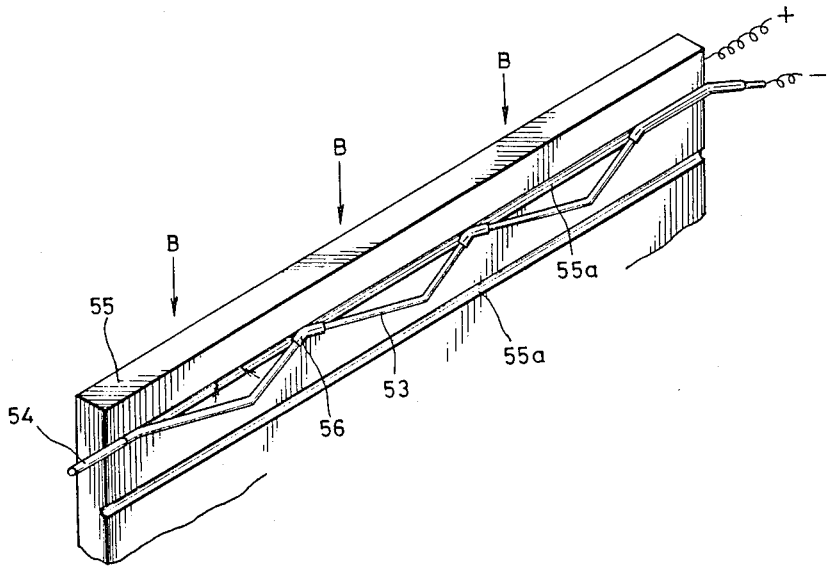
FIG. 8 is a perspective view showing another embodiment of the printing head with an actuator pin bent in a zigzag fashion and mounted on a common guide plate.

Another embodiment of this invention is shown in FIG. 8. In this embodiment, a single actuator pin 53 is used with a print pin 54 connected to the tip thereof. The actuator pin 53 is fitted in a guide groove **55*a* formed in a common guide plate 55 of a conductive nature. Insulation sleeves 53 are provided at the bending portions of the actuator pin 53 where they contact the common guide plate 55. The end portion of the actuator pin 53 is fixedly connected in the guide groove 55*a* to the common guide plate 55**, using adhesive agent.

In the embodiment shown in FIG. 8, since only one actuator pin is used, the laterally extending amount becomes small. Actuator pins may also be disposed at guide grooves formed on the other side face of the common guide plate 55 in a stagger fashion or in a facing fashion, to form two arrays of a plurality of print pins while maintaining a small pitch therebetween.

The present invention is not intended to be limited to the above embodiments, but various modifications may be possible without departing from the scope and spirit of this invention.

What is claimed is:

1. In a printing head for use a wire-dot printer wherein an actuator pin having one end fixed to a part of said printing head is positioned within a magnetic field and extends generally in a longitudinal direction from said one end to a tip thereof, and current is caused to flow in the actuator pin to generate electromagnetic force by which the actuator pin is deformed to extend said tip in said longitudinal direction to thereby record a dot, the improvement comprising:

said actuator pin being bent at least three longitudinally spaced points in a zig-zag fashion to form at least two V-shaped portions spaced successively in said longitudinal direction, each V-shaped portion of the pin having an apex and a pair of straight angularly related legs extending therefrom, with the straight angularly related legs of each V-shaped portion being not linearly aligned with the straight angularly related legs of an adjacent V-shaped portion.

2. A printing head for use in a wire-dot printer according to claim 1, wherein said actuator pin is made of phosphor bronze.

3. A printing head for use in a wire-dot printer according to claim 1, wherein said actuator pin is made of a berylium-copper alloy.

4. A printing head for use in a wire-dot printer for printing a dot using an electromagnetic force comprising:

first and second actuator pins each extending generally in a same longitudinal direction and each bent at at least three longitudinally spaced points in a zig-zag fashion to form a plurality of V-shaped portions, each such V-shaped portion having an apex and a pair of straight angularly related legs extending therefrom; means for fixing end portions of said first and second actuator pins to a part of said printing head;

a print pin fixedly mounted at tips of said first and second actuator pins;

said pins each having articulation portions between the adjacent legs of each V-shaped portion and insulating means on the articulation portions for electrically insulating the actuator pins from each other and from other parts of the head;

means for supplying a current from said first actuator pin to said second actuator pin; and means for applying a magnetic field to said first and second actuator pins.

5. In a printing head for use in a wire-dot printer wherein a plurality of actuator pins, each having a first end fixed to a part of said printing head, are positioned within a magnetic field, and current is caused to selectively flow in each actuator pin to generate electromagnetic force by which the actuator pin is formed to thereby record a dot, the improvement comprising:

each said actuator pin being bent to form a plurality of successive V-shaped portions; and a common guide plate formed with a plurality of guide grooves on at least one side face thereof;

wherein each of said guide grooves movably holds one of said actuator pins therein.

6. In a printing head for use in a wire-dot printer wherein a plurality of actuator pins, each having a first end fixed to a part of said printing head, are positioned within a magnetic field, and current is caused to selectively flow in each actuator pin to generate electromagnetic force by which the actuator pin is deformed to thereby record a dot, the improvement comprising:

said actuator pin being bent to form a at least one V-shaped portion; and a common guide plate formed with a plurality of guide grooves on at least one side thereof;

wherein each of said guide grooves movably holds one of said actuator pins therein; and wherein said common guide plate is electrically conductive, the end portion of said actuator pin is fixedly connected to said common guide plate using an insulation material, and a tip of said actuator pin electrically contacts said common guide plate.

7. A printing head for use in a wire-dot printer according to claim 6, wherein said plurality of guide grooves are disposed in a zigzag fashion on both side faces of said common guide plate.

8. A printing head for use in a wire-dot printer according to claim 7, wherein a printing pin is connected to the tip of each actuator pin.

9. A printing head for use in a wire-dot printer according to claim 8, wherein said at least one V-shaped portion is formed substantially at the middle of said actuator pin.

* * * * *